US005197570A

United States Patent [19]

Matsui

[11] Patent Number: 5,197,570

[45] Date of Patent: Mar. 30, 1993

[54] LINEAR MOTOR DRIVEN ELEVATOR WITH PASSING FUNCTION

[75] Inventor: Nobuyuki Matsui, Ichikawa, Japan

[73] Assignee: Kajima Corporation, Tokyo, Japan

[21] Appl. No.: 864,762

[22] Filed: Apr. 7, 1992

[30] Foreign Application Priority Data

Apr. 16, 1991 [JP] Japan ..... 3-83728

[51] Int. Cl.[5] ..... B66B 9/16

[52] U.S. Cl. ..... 187/16; 187/15; 187/17

[58] Field of Search ..... 187/17, 15, 16

[56] References Cited

U.S. PATENT DOCUMENTS

| | | | |
|---|---|---|---|
| 561,223 | 6/1896 | Hamilton | 187/16 |
| 1,231,075 | 6/1917 | Seeberger | 187/17 |
| 3,896,736 | 7/1975 | Hamy | 187/16 X |
| 4,004,654 | 1/1977 | Hamy | 187/16 |
| 5,005,672 | 4/1991 | Nakai et al. | 187/17 |

*Primary Examiner*—Robert P. Olszewski
*Assistant Examiner*—Dean A. Reichard
*Attorney, Agent, or Firm*—Armstrong, Westerman, Hattori, McLeland & Naughton

[57] ABSTRACT

The present invention provides an elevator system for transferring a large number of passengers at a high speed and for operating elevators to stop at each floor or as an express for passing floors. An ascending passage and a descending passage are sectionally formed in an elevator shaft having an upper turning portion, a fixed portion and a lower turning portion, respectively. Both the ascending and descending shafts are provided with a local line, a passing line and a sliding area. Switch frames for switching the line and the area are provided at a plurality of locations and a linear motor drive mechanism is provided on the cages and a center core of the elevator shaft.

1 Claim, 11 Drawing Sheets

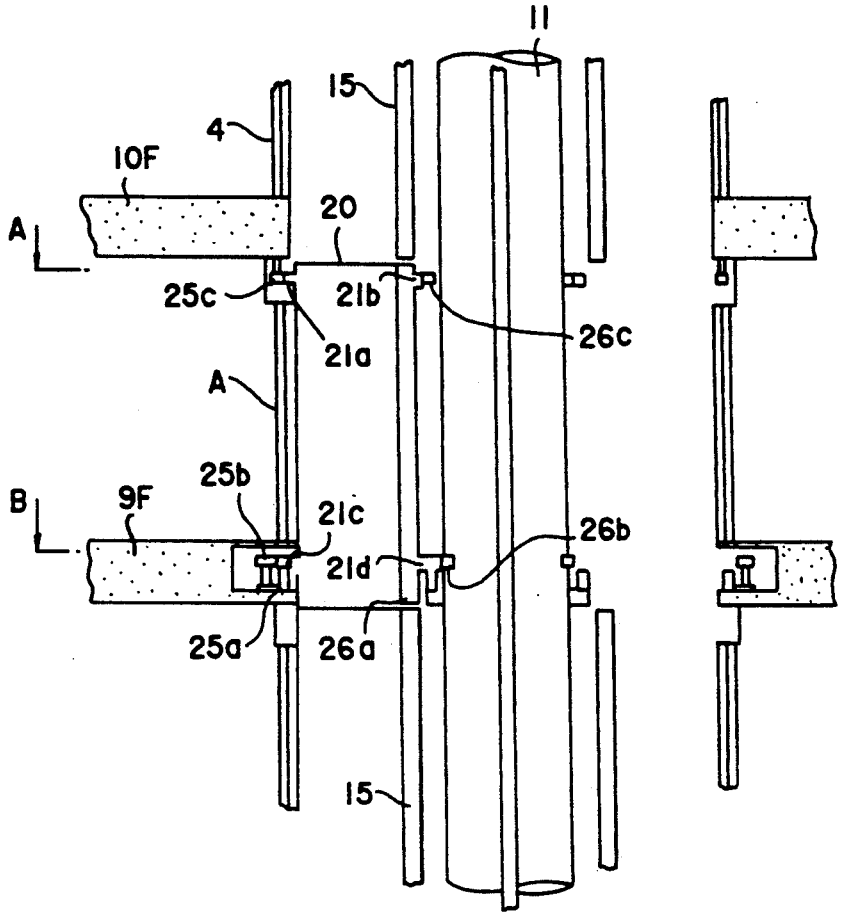
Fig.2
Fig.3
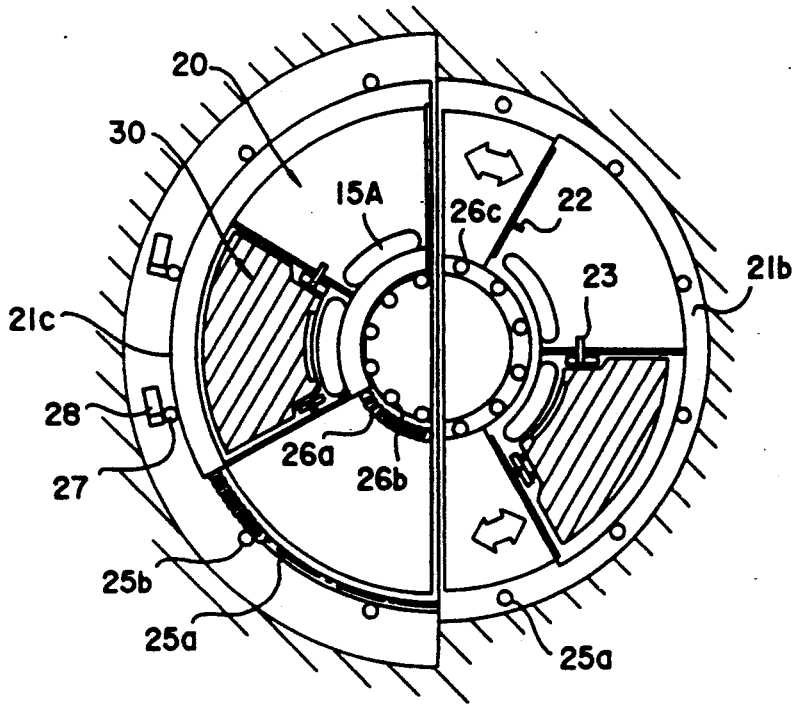

LINEAR MOTOR DRIVEN ELEVATOR WITH PASSING FUNCTION

BACKGROUND OF THE INVENTION

This application claims as priority Japanese Patent Application No. 3-83728, the subject matter of which is incorporated herein in its entirety.

1. Field of the Invention

The present invention relates to a linear motor driven elevator with passing function.

2. Description of the Related Art

Recently, corresponding to a trend in multistory building construction, high speed elevators have been required. Accordingly, a variety of high speed elevators have been supplied for such building construction purposes.

However, such high speed elevators use a raising and lowering mechanism operated by winch drum so that speed-up and transporting capacity are limited.

In Japanese patent application No. 2-207606, the subject matter of which is incorporated herein in its entirety, the present applicant proposed a linear motor driven elevator which is capable of realizing transportation at a high speed and with a large capacity.

While the above-mentioned elevator is effective, transportation capacity is still limited because a single line is provided for both the ascending and descending passages. Though it is possible to consider providing a plurality of lines, such an arrangement would result in a large-scaled facility. Furthermore, such an arrangement has a limitation for mass-transportation use, because a passing operation and a mixed operation of each floor stop and express are impossible.

SUMMARY OF THE INVENTION

It is an object of the present invention to provide a linear motor driven elevator with a passing function capable of achieving transportation at a high speed and with a large capacity, as well as capable of a mixed operation of each floor stop and express.

According to the present invention, a linear motor driven elevator with passing function is provided, wherein: a cylindrical elevator shaft has a fixed portion as well as a lower turning portion and an upper turning portion located, respectively, in the lower and upper part of the fixed portion; wherein a center core is provided vertically in each such portion and an ascending passage and a descending passage are sectionally formed opposedly around the center core; wherein a local line, a passing line and a siding area are provided sectionally in a respective passage and a plurality of cages is accommodated in both the lines, the cages and the center core being provided with permanent magnets and the linear motor primary coils, respectively, opposedly; and wherein locking means for selectively locking the cage are provided between the cage and the frame; and that at a plurality of locations a turnable switch frame, which is provided with a separately formed frame and a linear motor primary coil, and a turning means for the separately formed frame are provided wherein the switch frame is formed by the frame and the linear motor primary coil as a separate assembly.

In a preferred embodiment, the local line, the passing line and the siding area are each formed sectionally with a central angle of 60 degrees.

Also, elevator doors are, preferably, provided at the portion corresponding to the local line of the center core.

Further, preferably, the switch frame is provided at the fixed portion in the floor where the passengers get on and off rather frequently.

Also, preferably, the locking means comprise recesses formed on the frame and a stopping device provided with a pin for engaging with the recess when the cage stops.

Preferably, the turning means comprise rollers for supporting and guiding the cage, rollers rotating in abutment with the lower peripheral portion of the cage and a motor for driving said rollers.

And, preferably, both cages in both turning portions are constructed so as to be capable of turning by 360 degree.

In the linear motor driven elevator with passing function as described above, a linear synchronous motor (LSM) driving mechanism is composed of linear motor primary coils of center core and switch frame and permanent magnets of the cage. After the cage ascends at a high speed through the local line and the passing line of the ascending passage by means of this driving mechanism, the cage is shifted into the descending passage by an upper turning portion, and then descends through the local and passing lines. Thereafter, the cage is shifted into the ascending passage and again ascends through the ascending passage. In this way, a plurality of cages can ascend and descend successively in a cycle through the ascending passage and descending passage, respectively.

When a cage ascending through the passing line stops at a required floor, the switch frame is turned so as to be connected to the passing line and the siding area, and then the cage is stopped by fixing the cage to the switch frame. Then, the switch frame is turned in the reverse direction so as to connect the switch frame to the local line and passing line, such that the cage is shifted to the local line for passengers to get on and off.

When the switch frame is connected to the local line and the passing line and a preceding cage is located in the local line of the cage traveling frame or the switch frame, a cage located in the passing line can ascend or descend by passing through the switch frame. On the other hand, when the switch frame is situated in the same position as noted above, and a preceding cage is located in the passing line of the switch frame, a cage located in the passing line can ascend or descend by passing through the switch frame after the switch frame has been turned and connected to the passing line and the siding area. Furthermore, when the switch frame is connected to the passing line and the siding area and a preceding cage is located in the passing line of the switch frame, a cage located in the passing line can ascend or descend by passing through the switch frame after the switch frame has been turned and connected to the local line and the passing line.

BRIEF DESCRIPTION OF THE DRAWINGS

Other features and advantages of the invention will be apparent from the following description taken in connection with the accompanying drawings, wherein:

FIG. 2 is a sectional side view of FIG. 1;

FIG. 3 is a sectional view where the right side of the figure is taken along the line A—A of FIG. 2, and the left side of the figure is taken along line B—B of FIG. 2;

DESCRIPTION OF THE PREFERRED EMBODIMENT

Figure 1:
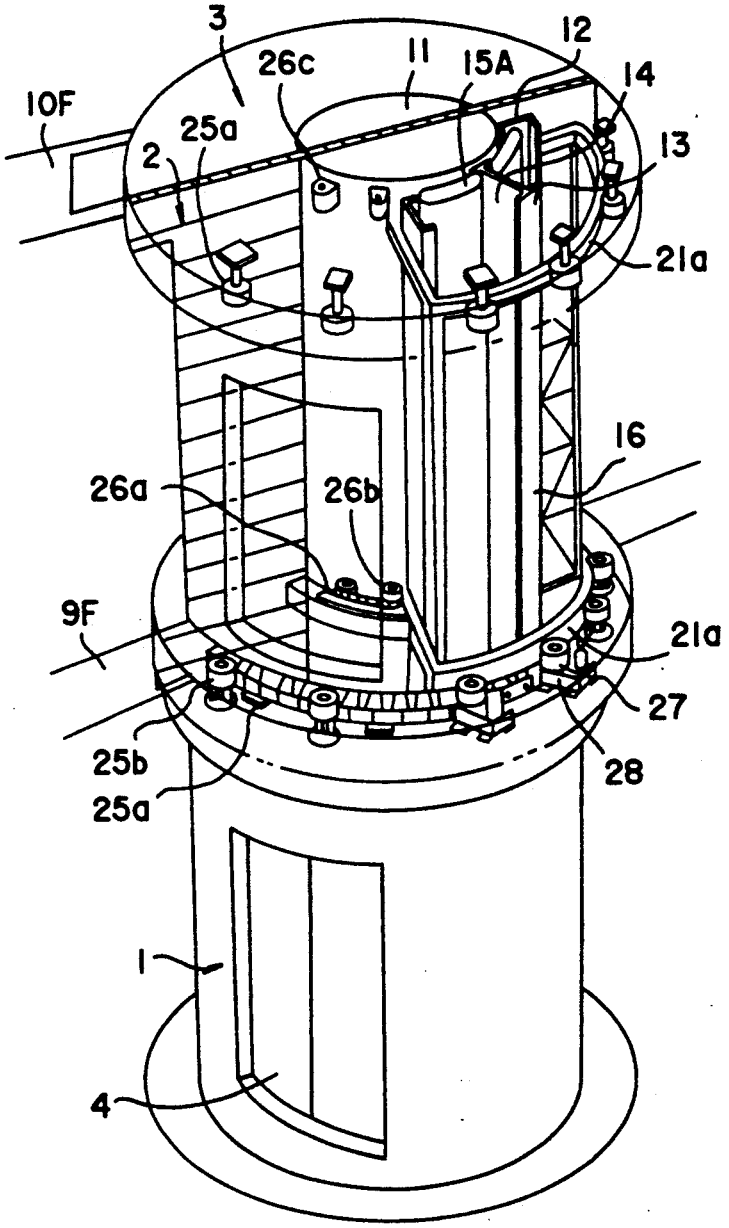
FIG. 1 is a perspective view of an example of the present invention showing the main components of the invention.
Figure 8:
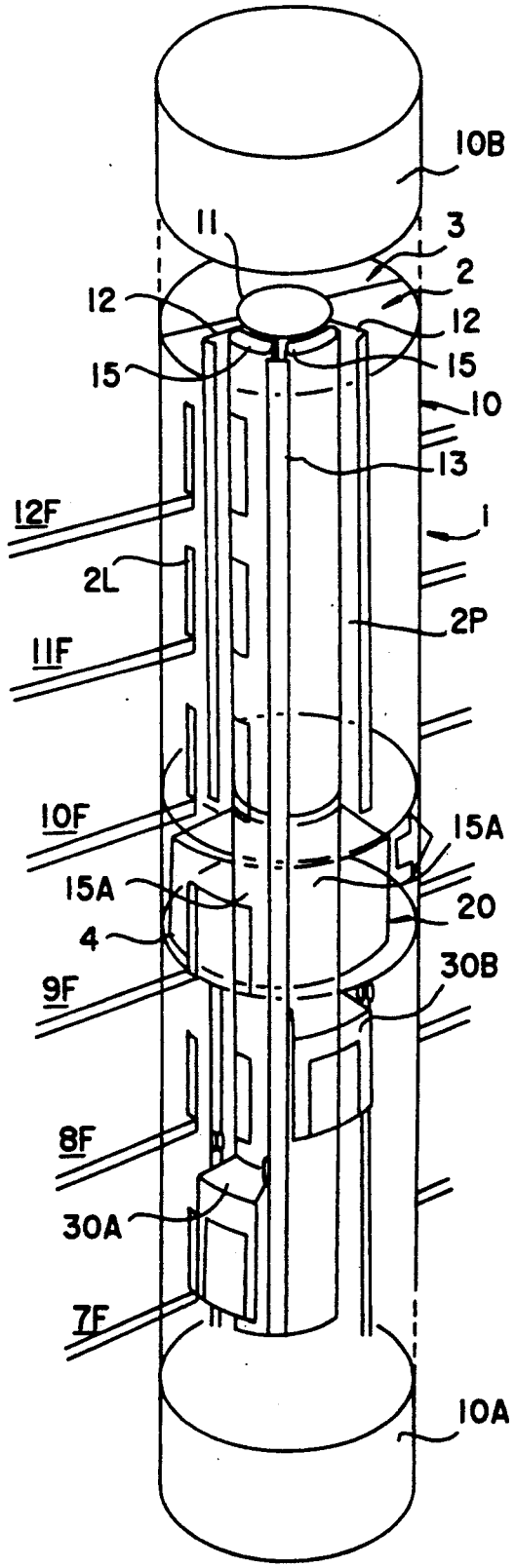
FIG. 8 is a perspective view illustrating the operating state of one embodiment.

In FIG. 1 and FIG. 8, in a cylindrical elevator shaft 1, there are provided a fixed portion 10, a lower turning portion 10A and an upper turning portion 10B, respectively, continuing downwards and upwards from the fixed portion 10. Thus, in the elevator shaft 1 an ascending passage 2 and a descending passage 3 are sectionally formed opposedly by both turning portions 10A, 10B and the fixed portion 10. In addition, a plurality of cages 30 (FIG. 3) is accommodated in both passages 2, 3.

Figure 9:
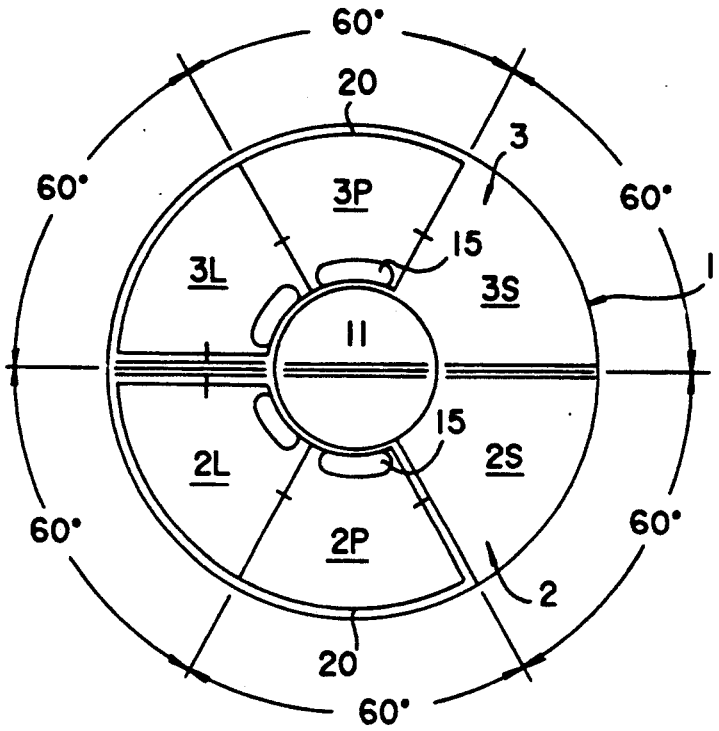
FIG. 9 is a horizontal sectional view at 10F (the 10th floor) in FIG. 8.

In the center line of the fixed portion is provided a vertical center core 11. In the side of both passages 2, 3 on the core 11, three cage travelling rails 12, 13, 12 are projectingly provided at 60 degree angles from the center. The rails at both sides are formed of channel steel and the center rail is formed of H-type steel wherein recesses 14 (the same as the recesses 24 in FIG. 4) are formed at a predetermined pitch in the external edge of these rails. Between one side rail 12 and the rail 13, and between the rail 13 and the other side rail 12, respectively, are provided linear motor primary coils 15,15. In the ascending passage 2, the local line 2L for each floor stop and the passing line 2P for express, are sectionally formed. In addition, in the descending passage 3, the local line 3L for each floor stop and the passing line 3P for express are sectionally formed, as shown in FIG. 9. The elevator shaft 1 is provided with an elevator door 4 at each floor at the location corresponding to the local lines 2L, 3L. Also, at a plurality of locations of the fixed portion 10 (only 9th floor is shown in the illustrated example) a separate frame made of a rail and coil is formed independently from the rails 12, 13 and the coil 15 (FIGS. 3 to 5) and this separate frame provided with rails 22, 23 and coil 15A or switch frame generally shown as 20 is circumferentially and turnably mounted.

Figure 4:
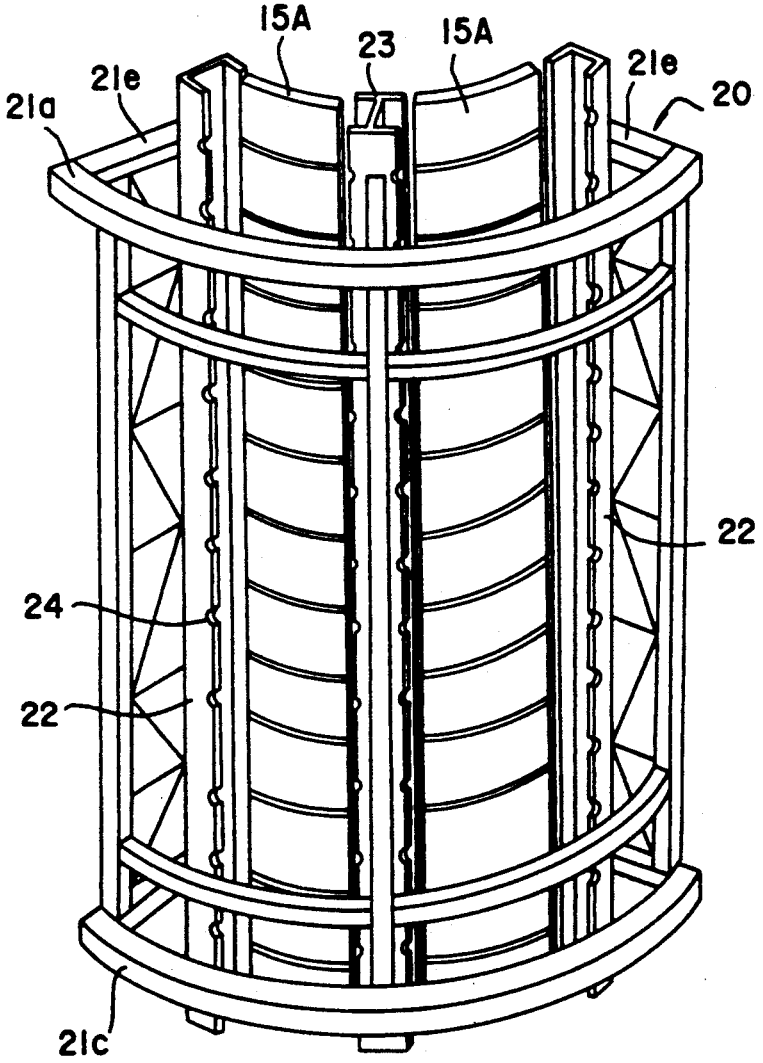
FIG. 4 is a perspective view showing the face side of a switch frame.
Figure 5:
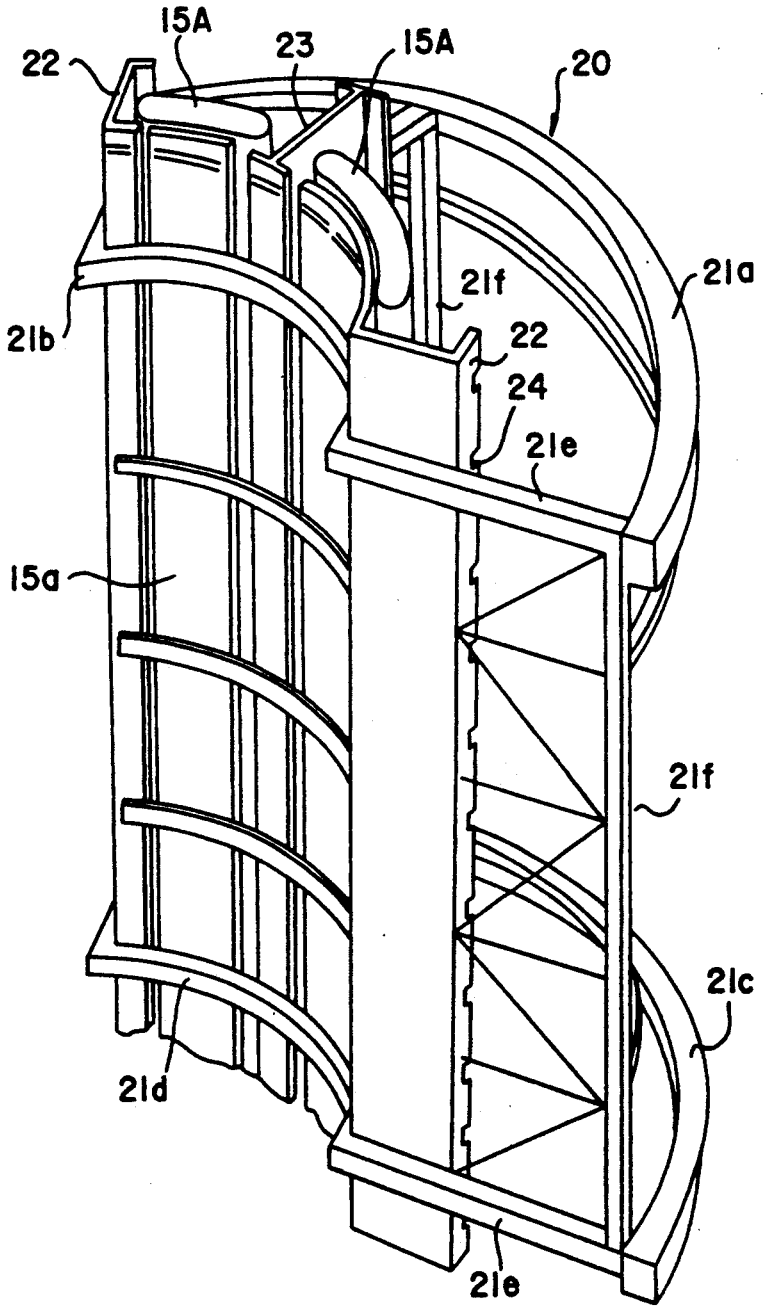
FIG. 5 is a perspective view showing the back side of the switch frame.

As shown in FIGS. 4 and 5, the switch frame 20 is provided with an upper outside guide rail 21*a*, an upper inside guide rail 21*b*, a lower outside guide rail 21*c* and a lower inside guide rail 21*d*, respectively, each in an arc-shape, wherein these guide rails are connected to each other into a frame by connecting members 21*e*, 21*f*. Inside each rail 21*a*–21*d* are provided cage travelling rails 22, 23 aligned, at one portion, to the cage travelling rails 12, 13, respectively, and linear motor primary coils 15A, 15A supported by coil set plates 15*a*, 15*a*. On these rails 22, 23, is formed a plurality of recesses 24 at the same pitch as the recesses on said rails 12, 13.

As shown in FIGS. 1 to 3, the 9th floor is provided with a plurality of lower outside vertical rollers 25*a* supporting the lower outside guide rail 21*c* of the switch frame 20 at the lower surface thereof, and a plurality of lower outside horizontal rollers 25*b* guiding the lower outside guide rail 21*c* at the side surface thereof. In addition, the lower surface of the 10th floor is provided with a plurality of upper outside horizontal rollers 25*c* guiding the upper outside guide rail 21*a* at the side surface thereof. On the other hand, the center core 11 is provided with a plurality of lower inside vertical rollers 26*a* supporting the lower inside guide rail 21*d* at the lower surface thereof and a plurality of lower inside horizontal rollers 26*b* guiding the lower inside guide rail 21*d* at the side surface thereof. Also, a plurality of upper inside horizontal rollers 26*c* guide the upper inside guide rail 21*b* at the side surface thereof.

Furthermore, on the substantially same circumference as the lower outside horizontal rollers 25*b* is provided a plurality of drive rollers 27 rotated in abutment with the side surface of the lower outside guide rail 21*c*, to thereby turn the switch frame 20 left and right within a 60 degree range. The drive rollers 27 are driven by a switch frame drive motor 28. And, the switch frames 20 corresponding to the lower turning portion 10A and the upper turning portion 10B are capable of turning by 180 degrees.

Figure 7:
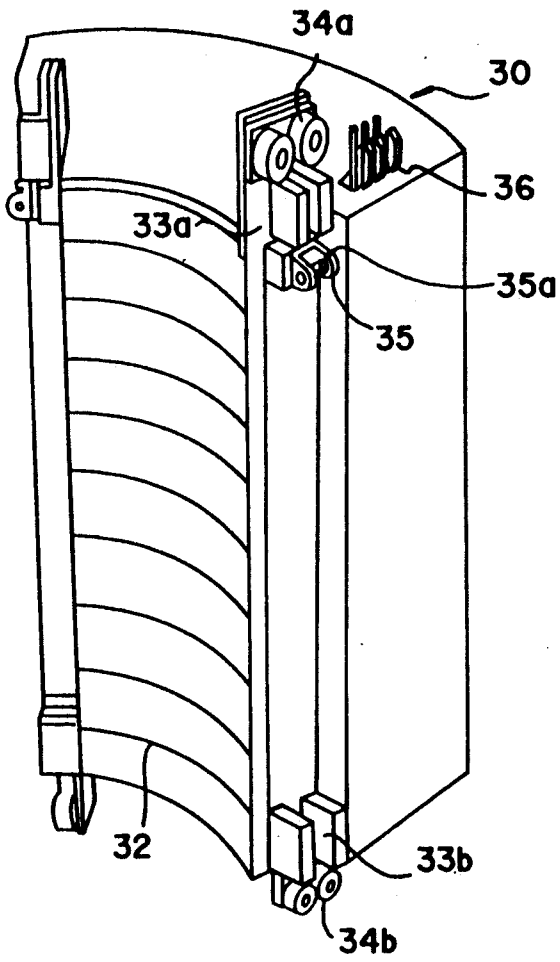
FIG. 7 is a perspective view showing the back side of the cage.
Figure 6:
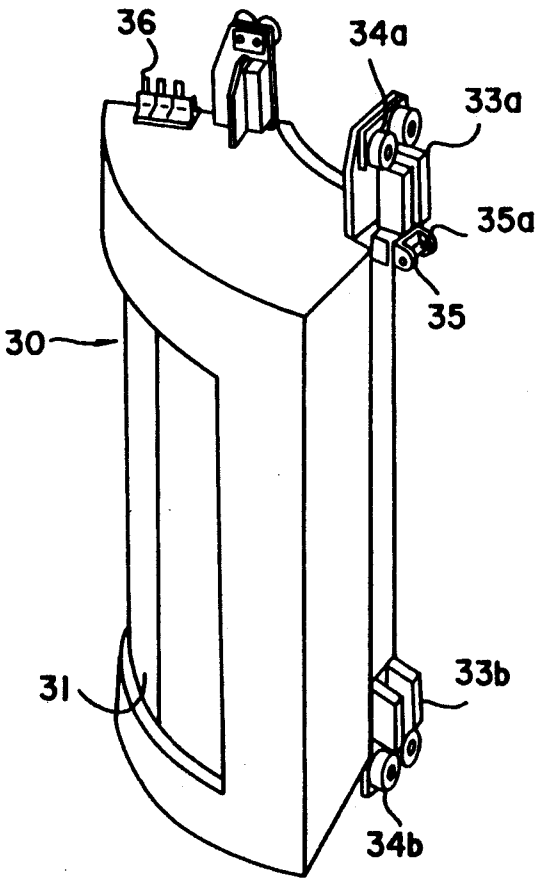
FIG. 6 is a perspective view showing the face side of a cage.

In FIG. 6 and FIG. 7 (these drawing show the face side and the back side of a cage 30, respectively), the cage 30 has a cross-sectional shape defined by two circular arcs. A door 31 is mounted in a face side of the cage so as to be openable and closable, and permanent magnets 32 opposing to the linear motor primary coils 15, 15A are mounted on the back side. Thus, a linear synchronous motor (a so-called LSM) is provided, and is composed of the linear motor primary coils 15, 15*c* and permanent magnets 32. However, without being limited thereto, other motors, such as a linear induction motor, (a so-called LIM), etc. can also be used.

Both upper and lower ends of said cage 30 are provided with upper guide plate 33*a*, upper guide rollers 34*a* and lower guide plate 33*b*, and lower guide rollers 34*b* for being guided by the edges of the cage traveling rails 12, 13 and 22, 23. Below the upper guide plate 33*a* is provided a stopping device 35 comprising a pin 35*a* for engaging with a recess 14, 24 by protruding at the time of stopping. Thus, a locking means is provided, which is composed of the stopping device 35 and recesses 14, 24. In addition, at the inside of one of the upper guide plate 33*a*, a current collector 36 is provided.

Figure 10:
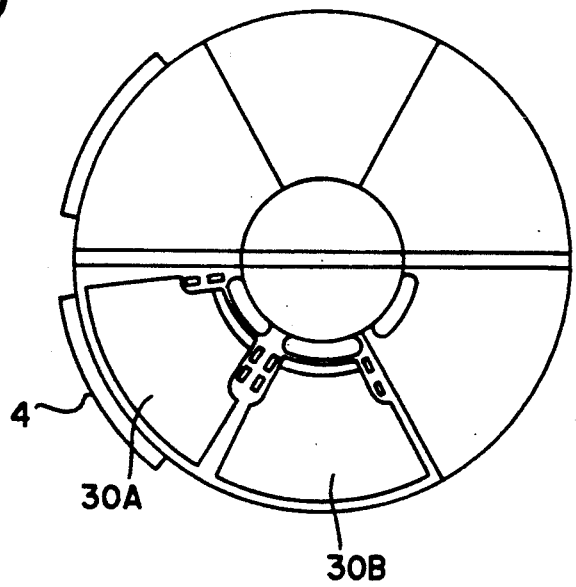
FIG. 10 is a horizontal sectional view at 8F (the 8th floor) in FIG. 8.

The operation of the elevator according to the invention is as follows:

In FIGS. 8 to 10, the ascending passage 2 and the descending passage 3 are formed sectionally with an ascending siding area 2S and a descending siding area 3S normally by the switch frame 20, 20.

The side of an ascending passage 2 will be explained, as an example. By means of a linear synchronous motor driving mechanism, a cage 30A ascends through the local line at each floor stop operation and a cage 30B ascends through the passing line 2P at a high speed. At the upper turning portion 10B, the cages 30A, 30B, respectively, are shifted to the local line 3L and the passing line 3P of the descending passage 3 by means of the turning of the upper turning portion 10B, to finally descend through the descending passage 3.

When the cage 30A, 30B is stopped at a required floor, the pin 35*a* of the stopping device 35 protrudes and consequently fixes the cage 30A, 30B to the cage traveling rail 12, 13 or 22, 23 by engaging with the recess 14 or 24. Thereafter, at the lower turning portion 10A the cage 30A, 30B is shifted to the local line 2L and the passing line 2P of the ascending passage 2 by the turning of the lower turning portion 10A. In such a way, a plurality of cages 30 ascends and descends successively in a cycle through the ascending passage 2 and the descending passage 3.

In a case where the cage 30A is stopping at the 7th floor, for example, for passengers getting on-and-off and which is expected to stop next at the 8th floor, and the cage 30B is intending to stop at the 9th floor wherein the switch frame 20 at the 9th floor is connected to the local line 2L and the passing line 2P, the switch frame 20 is connected to the passing line 2P and the siding area 2S by being turned as shown by the arrow (FIG. 8). Then, the cage 30B ascends through the passing line 2P (FIG. 10), passes the cage 30A and stops by entering into the switch frame 20. Subsequently, the switch frame 20 is turned in the reverse direction against the above so that the cage 30B is shifted to the local line 2L for the passenger getting on-and-off through the door 4. And, the cage 30A will stop at the 8th floor as expected.

Figure 12:
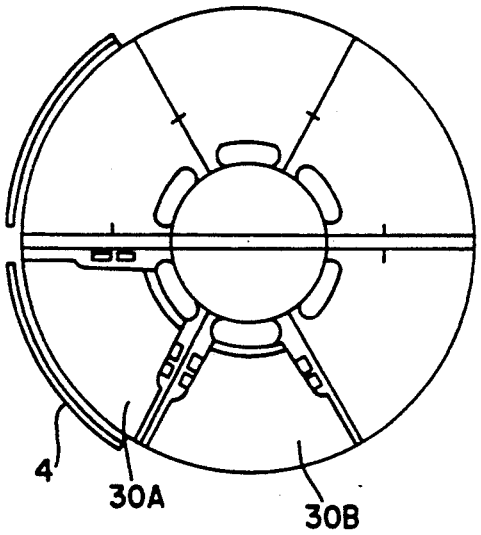
FIG. 12 is a horizontal sectional view at 8F (the 8th floor) of FIG. 11.
Figure 11:
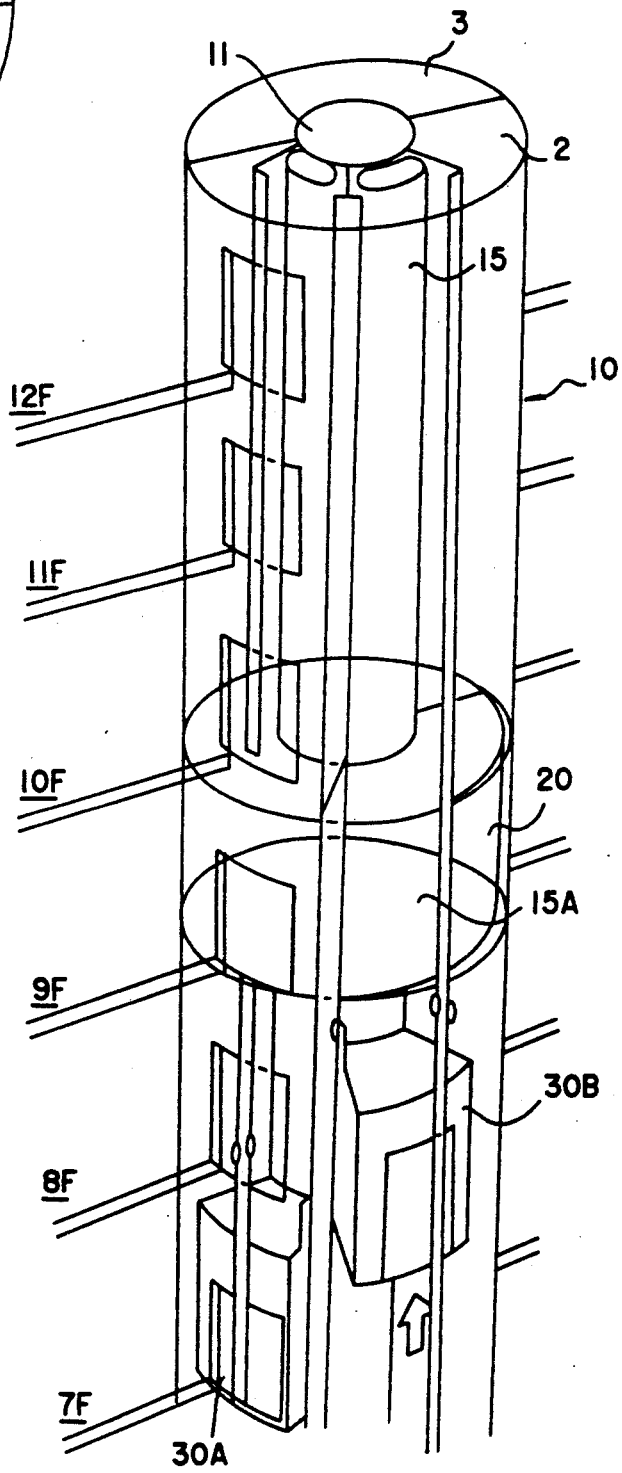
FIG. 11 is a perspective view showing another example of an operating state of the present invention.
Figure 13:
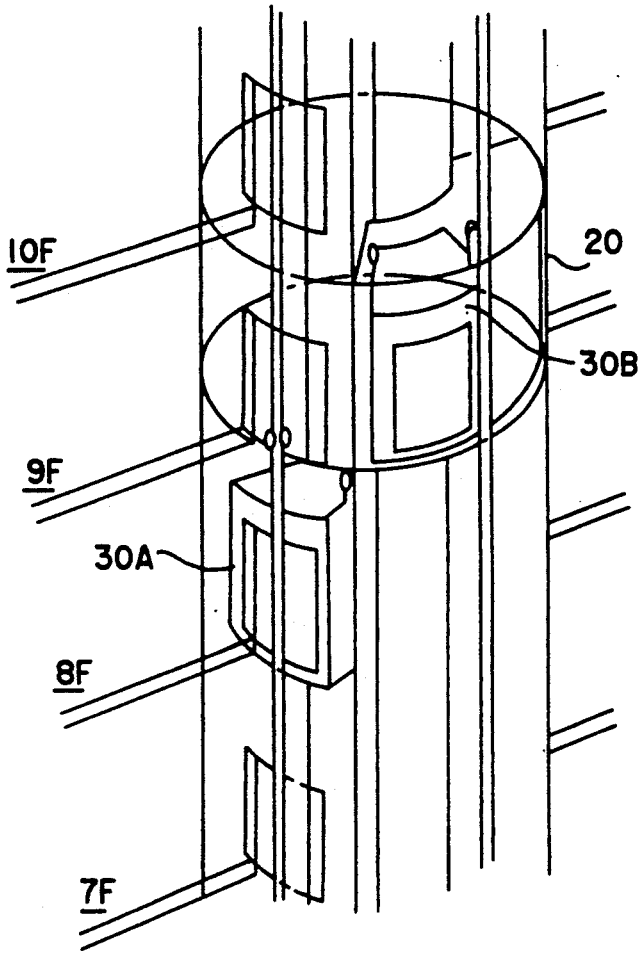
FIG. 13 is a perspective view showing a state in which a cage is stopped by entering into the switch frame.
Figure 14:
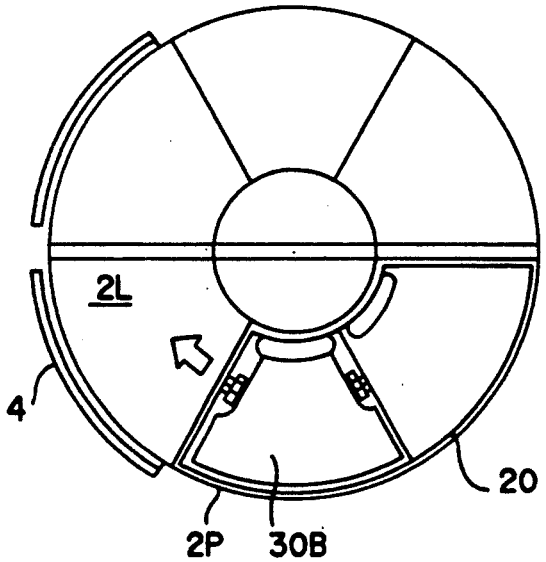
FIG. 14 is a horizontal sectional view of FIG. 13.

In addition, as shown in FIG. 11 and FIG. 12, in the case where the cage 30A is stopping at the 7th floor for passengers getting on-and-off and is expecting a next stop at the 8th floor, and the cage 30B is intending to stop at the 9th floor, wherein the switch frame 20 at the 9th floor is connected to the passing line 2P and the siding area 2S, the cage 30B stops by entering into the switch frame 20 (FIG. 13). Subsequently, the switch frame 20 is turned in the direction as shown by the arrow (FIG. 14) so that the cage 30B is shifted to the local line 2L for the passenger getting on-and-off through the door 4.

Figure 16:
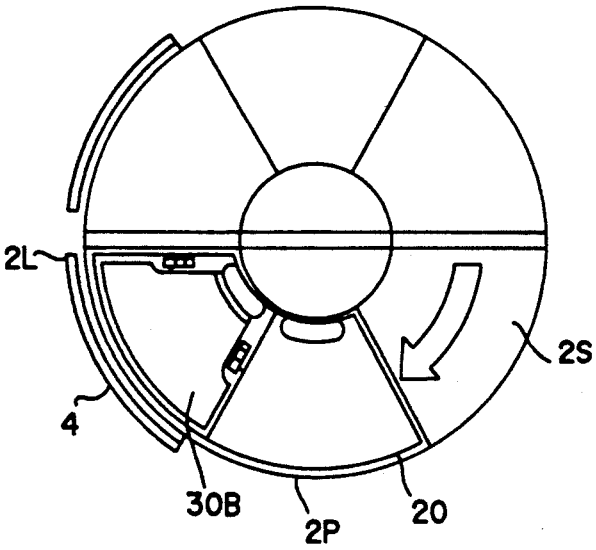
FIG. 16 is a horizontal sectional view of the 9th floor of FIG. 15.
Figure 15:
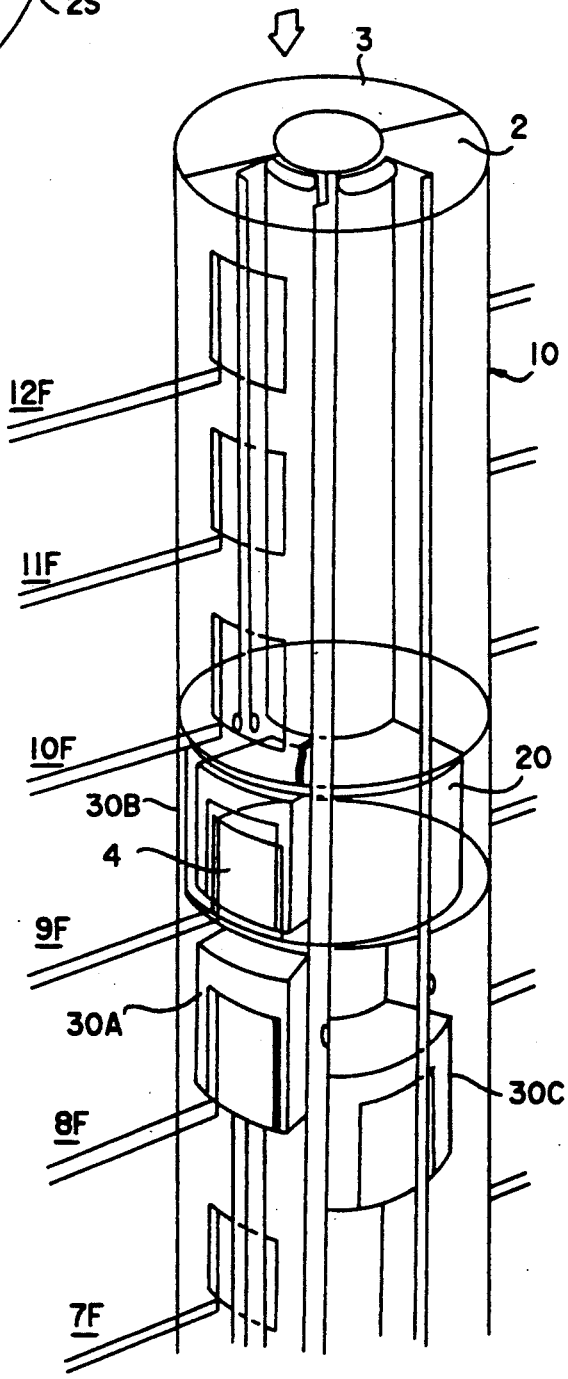
FIG. 15 is a perspective view showing another example of an operating state of the present invention.
Figure 18:
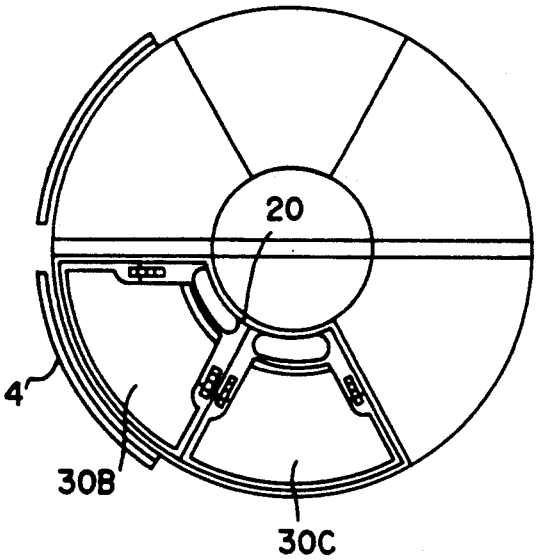
FIG. 18 is a horizontal sectional view at 9F (the 9th floor) in FIG. 17.
Figure 17:
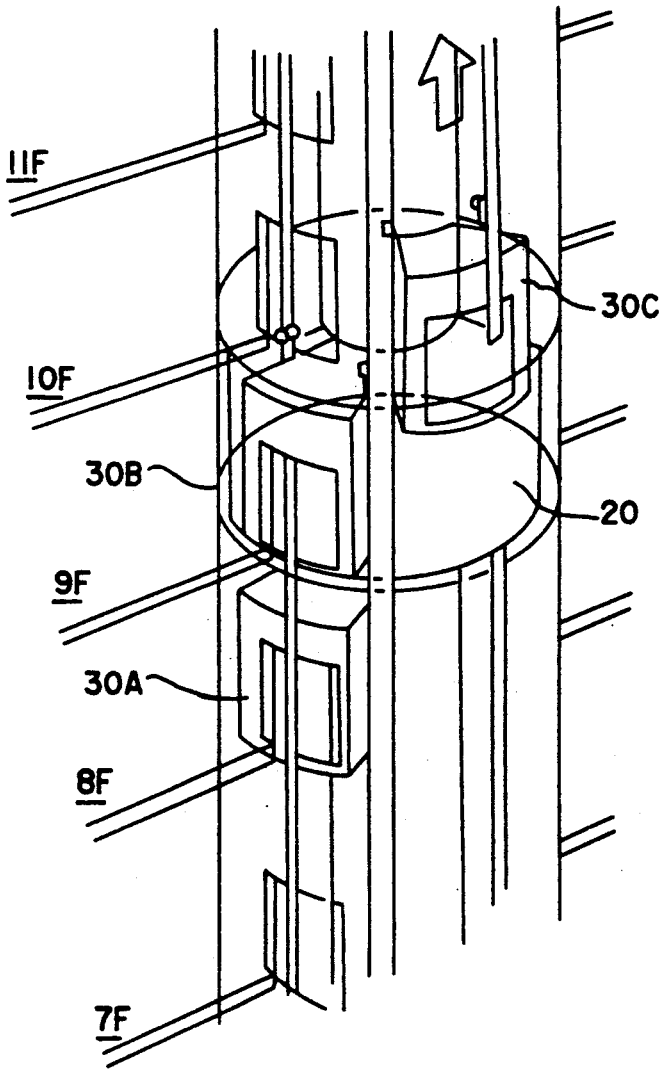
FIG. 17 is a perspective view showing a state in which a cage is passing through the switch frame.

Also, as shown in FIGS. 15 and 16, in the case where the cage 30A is stopping at the 8th floor for passengers getting on-and-off expecting a next stop at the 9th floor and the cage 30B is stopping at the 9th floor for passengers getting on-and-off, and the cage 30C is ascending from the 7th floor to the 12th floor, the switch frame 20 at the 9th floor is connected to the local line 2L and passing line 2P by being turned from the passing line 2P and the siding area 2S (FIG. 16), and the cage 30C ascends (FIGS. 17 and 18) by passing through the switch frame 20.

Other modifications and alterations within the scope of the invention will become apparent to those skilled in the art from the foregoing description and accompanying drawings, and it should be understood that the emodiments described herein are illustrative and not limiting.

We claim:

1. An elevator system having a substantially cylindrical elevator shaft comprising therein:

a fixed shaft portion;

a lower turning portion disposed adjacent a lower part of said fixed shaft portion;

an upper turning portion disposed adjacent an upper part of said fixed shaft portion;

a center core extending axially through each of said fixed shaft portion, lower turning portion and upper turning portion;

an ascending passage formed on a first side of said center core and extending axially adjacent thereto;

a descending passage formed on a second side of said center core opposite to said first side and extending axially adjacent thereto;

a local line, a passing line and a siding area sectionally provided and axially extending within both said ascending and descending passages;

a plurality of cages disposed within at least one of said ascending and descending passages for moving axially in a first direction in said ascending passage and for moving in an opposite direction in said descending passage;

wherein said plurality of cages are provided with permanent magnets;

wherein said center core is provided with linear motor primary coils for interacting with said magnets provided on said cages;

a plurality of switch frames axially and turnably disposed along at least one of said ascending and descending passages, each of said switch frames comprising a frame, a linear motor primary coil and a turning means for turning the frame; and locking means for selectively locking a cage of said plurality of cages to a respective frame of a switch frame of said plurality of switch frames.

* * * * *